United States Patent [19]

Jones, Jr. et al.

[11] 3,965,401

[45] June 22, 1976

[54] TEXTILE CARD CRUSH ROLL OPERATING SYSTEM AND METHOD

[75] Inventors: Louis L. Jones, Jr.; William J. Wood, both of Canton, Ga.

[73] Assignee: Canton Textile Mills, Inc., Canton, Ga.

[22] Filed: May 31, 1974

[21] Appl. No.: 474,967

[52] U.S. Cl. ..... 318/6; 318/305; 318/447; 318/487; 19/106 R

[51] Int. Cl.² ..... B65H 59/38

[58] Field of Search ..... 318/443, 444, 447, 6, 318/305, 224, 225, 487; 19/25, 106 R

[56] References Cited

UNITED STATES PATENTS

| | | | |
|---|---|---|---|
| 631,022 | 8/1899 | Marsden | 19/106 R |
| 1,132,878 | 3/1915 | Pilling | 19/106 R |
| 2,302,700 | 11/1942 | Lambach | 318/305 X |
| 2,370,672 | 3/1945 | Lambach | 318/305 |
| 2,455,502 | 12/1948 | Kronoff et al. | 318/443 X |
| 2,624,032 | 12/1952 | Hennessy | 318/447 |
| 2,903,635 | 9/1959 | Broote et al. | 318/488 |
| 2,931,962 | 4/1960 | Huck | 318/6 |
| 3,199,151 | 8/1965 | Bird | 19/25 |
| 3,263,460 | 8/1966 | Kabelitz et al. | 318/6 X |
| 3,372,320 | 3/1968 | Boyum et al. | 318/6 X |
| 3,474,298 | 10/1969 | Tellerman | 318/443 X |
| 3,487,283 | 12/1969 | Cook | 318/443 |
| 3,594,625 | 7/1971 | Richardson | 318/305 X |
| 3,665,277 | 5/1972 | Velozquez | 318/447 |
| 3,725,975 | 4/1973 | Varga et al. | 19/106 R |
| 3,881,223 | 5/1975 | Brown | 19/106 R |

*Primary Examiner*—Robert K. Schaefer
*Assistant Examiner*—John J. Feldhaus
*Attorney, Agent, or Firm*—Walter M. Rodgers

[57] ABSTRACT

A textile card crush roll operating system is driven by a two-speed electric motor completely independent of the main card cylinder driving motor and is provided with starting control means for operating the crush roll motor at slow speed for a pre-determined time according to automatically operable timing means during which interval sliver from the crush rolls is manually fed into an associated coiler and arranged in such a way that tension of the sliver is applied to stop control means which stops operation of the two-speed crush roll motor after the motor is accelerated to its high speed condition under the control of operating control means. Thus if sliver tension is substantially reduced, the crush roll system is automatically shut down.

7 Claims, 4 Drawing Figures

TEXTILE CARD CRUSH ROLL OPERATING SYSTEM AND METHOD

Conventional textile card crush roll driving systems are coupled mechanically to the main card driving motor and mechanical clutch means is utilized to change the operating speed of the crush rolls relative to the speed of the main card cylinder. Conventional driving systems as described utilize a conventional driven pulley and an idler pulley arranged so that a driving belt operated from the driving motor for the main card may be shifted from a driven pulley to an idler pulley and vice versa to effect changes in operation of the crush roll system. This arrangement is objectionable because shifting of the belt from the driven pulley to the idler pulley and vice versa frequently is only partially completed so that slippage of the belt may occur due to a small area of contact between the belt and the driven pulley. Belt slippage of course results in improperly controlled speed of operation of the crush roll system and associated apparatus. Conventional arrangements as described are also objectionable in that they require considerable floor space and thus interfere with an operator's access to the card, to the crush rolls and to associated apparatus. Furthermore conventional practice is such that once a card is started and while the crush roll system is operating at slow speed, an operator threads the sliver output from the crush roll system into a conventional coiler. Normally the operator then manually increases the speed of the crush roll system once the sliver is properly fed into the coiler. Where an operator is pressed for time or tends to procrastinate in completing a sliver threading operation, the whole system is permitted to operate at slow speed and this slow speed condition may be allowed to persist for long periods of time thereby inhibiting production substantially.

According to the present invention, a textile card crush roll operating system is provided which is completely independent of the operating system for the main card cylinder and comprises a two-speed crush roll driving motor together with starting control means for energizing the motor in such manner as to operate the motor at low speed and including timing means actuated in coordination with actuation of the starting control means to initiate a timing cycle which after a time interval initiates operation of operating control means so as to cause the two-speed motor to shift to high speed operation together with automatic stop control means responsive to normal operating tension of the sliver supplied from the crush rolls for normally maintaining the operating control means in operable condition and for rendering such operating control means ineffective to continue operation of the motor at high speed in response to a substantial reduction in sliver tension.

For a better understanding of the invention reference may be had to the following detailed description taken in conjunction with the accompanying drawings in which FIG. 1 is a schematic representation of a textile card including a crush roll system and an associated coiler together with operating means provided according to this invention;

FIG. 3 is a cross-sectional side view of a so-called wheel station which together with certain circuit elements constitutes stop-control means for the crush roll operating system and which responds to tension of sliver from the crush rolls to the associated coiler; and in which

Figure 1:
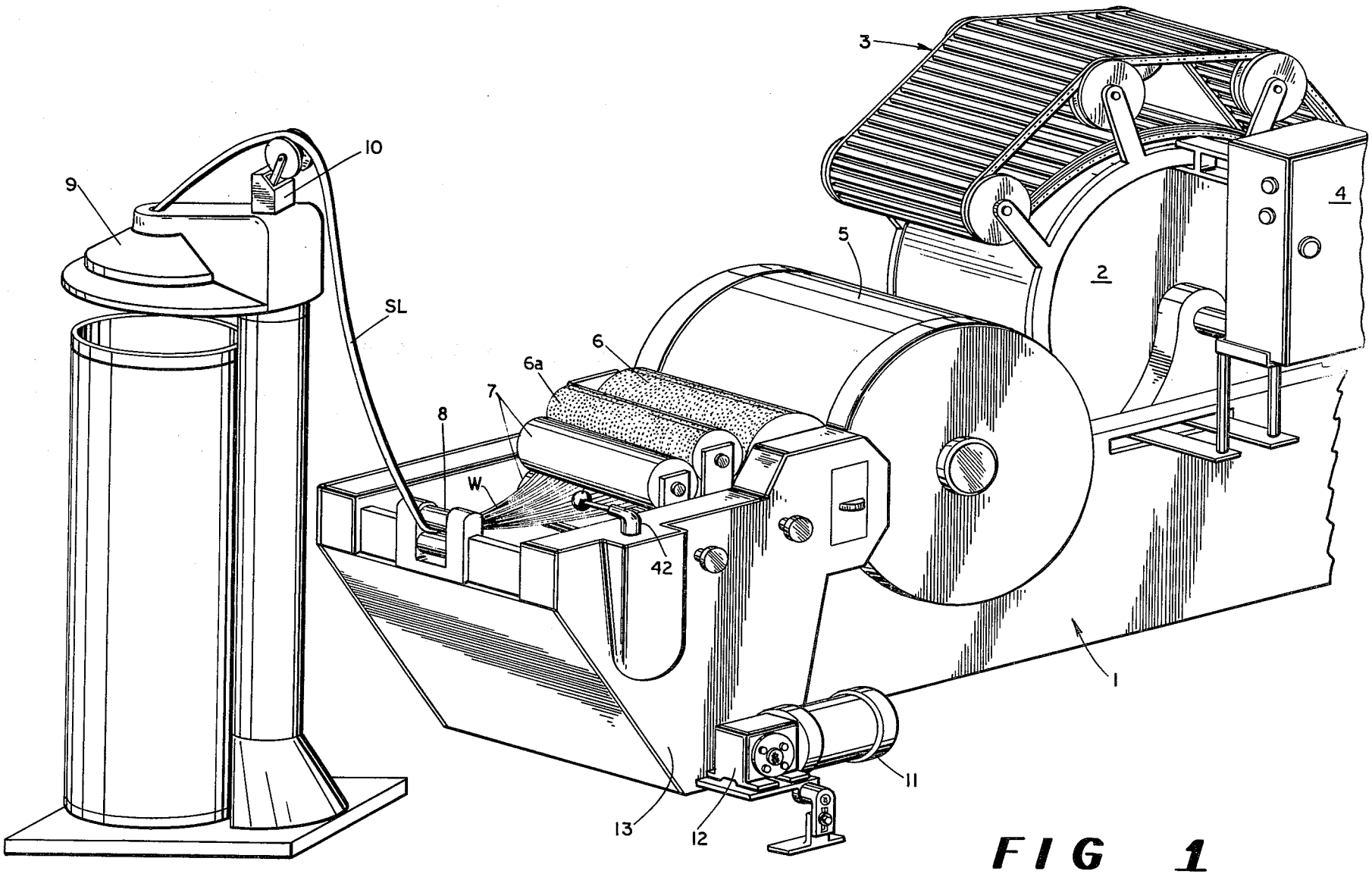
Figure 2:
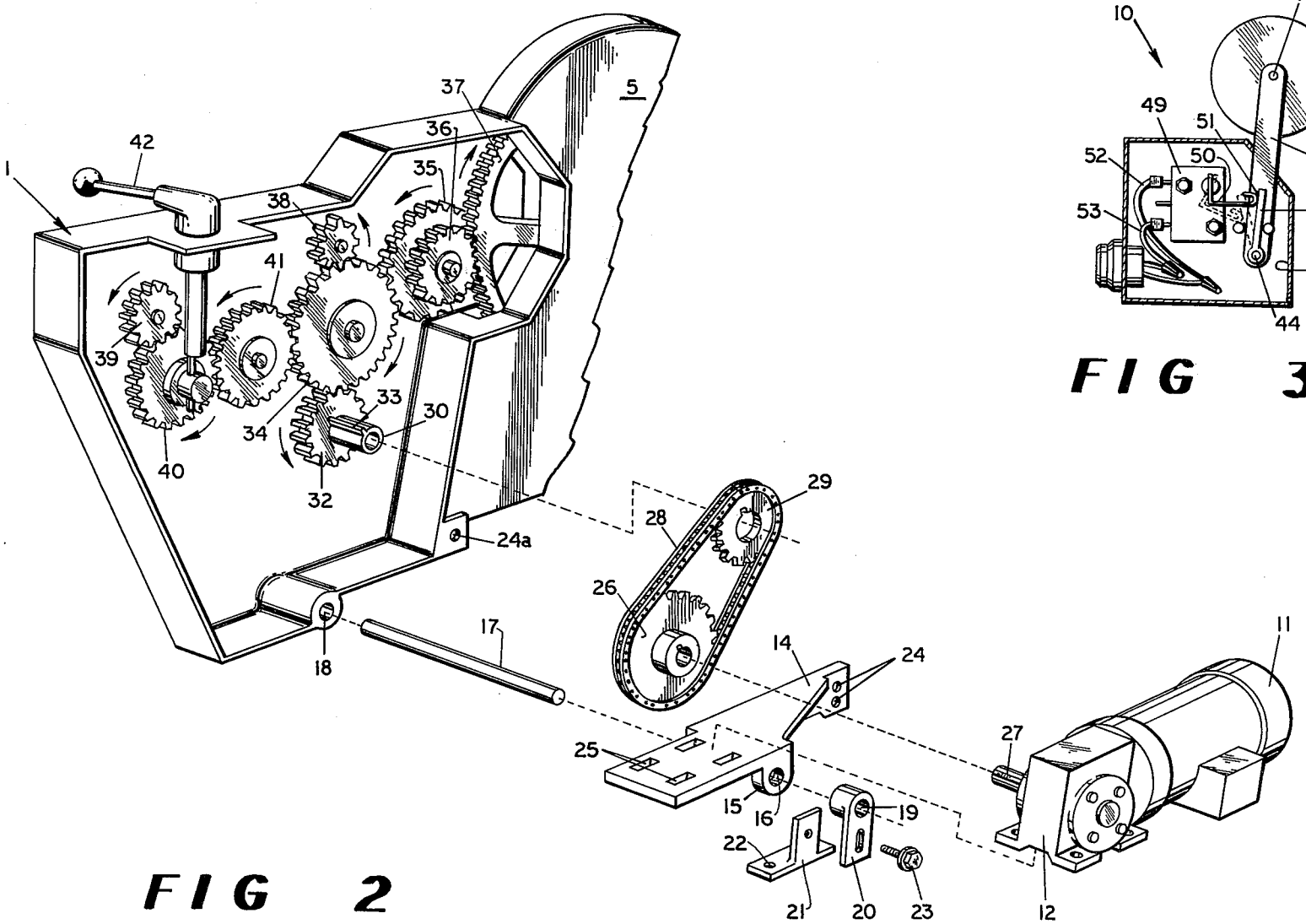
FIG. 2 is an exploded view of certain operating elements associated with the crush rolls, with the calendar rolls, with the doffer, and with the take-off roll and including a driving motor and its mounting means.

With reference to FIGS. 1 and 2, the numeral 1 generally designates the card frame and the numeral 2 generally designates the main card cylinder with which the flats generally designated by the numeral 3 cooperate in known manner. A control cabinet 4 is mounted in any suitable manner on frame 1 and includes the principal electric components of a control system arranged according to this invention. The numeral 5 generally designates a conventional doffer while the numeral 6 is used to designate a conventional take-off roll. The numeral **6*a* is used to designate a conventional re-directing roll which rotates in a counter-clockwise direction as viewed in FIGS. 1 and 2. Roll 6*a* is driven by gears (not shown) which are disposed at the ends thereof remote from cover 13 so that rotation of roll 6 imparts rotation to roll 6*a*. The crush rolls are designated by the numeral 7 and serve to crush foreign matter from web W and the calendar rolls are designated generally by the numeral 8 while the associated coiler is generally deisgnated by the numeral 9. A trumpet (not shown) aids in directing web W into the calendar rolls. Crush rolls 7 and calendar rolls 8 are coupled together at the far ends of these rolls so that driving one such roll imparts rotary motion to the other roll in the opposite direction in conventional manner. Sliver SL is fed from the crush rolls through the calendar rolls into the coiler 9 and is threaded over the wheel station generally designated by the numeral 10**. The wheel station constitutes means for sensing sliver tension.

For driving the crush roll system, a two-speed motor generally designated by the numeral 11 is provided with a reduction gear box generally designated by the numeral 12. Thus when the motor 11 is driven, the reduction gear 12 is operated and in turn through appropriate driving means imparts operating movement to the crush roll system and associated apparatus as shown on FIGS. 1 and 2, it being understood that the main card cylinder 2 is operated by a separate motor.

Although not shown in the drawings, a conventional feed roll and licker-in are provided at the back of the card together with a suitable lap all of which are rotated by a shaft (not shown) but which is driven by the motor 11. The main card cylinder 2 which is driven by a separate motor (not shown) is independent of all the rest of the system.

Operating movement is imparted to the crush roll system and associated apparatus by suitable gears, sprockets, chains, clutches and the like which are enclosed behind a housing cover generally designated by the numeral 13 as shown in FIG. 1.

FIG. 2 represents the driving mechanism schematically and shows the various parts in exploded fashion and with the cover 13 removed. With reference to FIG. 2, a motor mounting plate 14 is provided with a pair of downwardly projecting brackets 15, only one of which appears in FIG. 2, and which are provided with apertures 16 for receiving support rod 17. Support rod 17 is mounted at one end in an aperture 18 formed in frame 1 and the other end of support rod 17 is disposed within an aperture 19 formed in supporting element 20 adjustably mounted by bolt 23 to support bracket 21 which is secured to the floor in any suitable manner such as by bolts disposed within apertures 22. Support plate 14 is fixed in position by a suitable mounting bolt not shown which is disposed within one of the mounting openings 24 and in threaded aperture 24*a* formed in frame 1. Motor 11 and its gear box 12 are secured atop mounting plate 14 by suitable bolts which extend through the feet of the mechanism and also through mounting apertures formed in mounting plate 14 and designated by the numeral 25.

With the motor 11 and its driving gear 12 assembled and mounted in the manner shown in FIGS. 1 and 2, operating movement is applied to the crush roll system by a train of operating elements which includes sprocket 26 secured to gear shaft 27 and provided with chain 28 which cooperates with driven sprocket 29 mounted on shaft 30 which in turn is journally supported by frame 1 in any suitable manner. A pinion 32 is secured as by a pin 33 to shaft 30 and when rotated imparts rotary motion to idler gear 34 suitably mounted on frame 1 by journal bearings. Rotation of idler gear 34 imparts rotary motion to gear 35 which in turn is provided with a unitary pinion 36 arranged to mesh with ring gear 37 forming a part of doffer 5 so that rotation of these elements imparts rotary motion to doffer 5 which is in a clockwise direction as viewed in FIGS. 1 and 2. Take off roll 6 is mounted on the same shaft as gears 35 and 36 and is rotated by gear 35.

In order to impart rotary motion to the crush rolls 7, a driving pinion 38 is rotatably mounted on frame 1 and secured to the shaft on which one of the crush rolls 7 is fixedly mounted. Thus rotation of pinion 38 imparts counter clockwise rotation to one of the crush rolls 7. Since the far end of the top crush roll 7 is provided with a driving gear coupled with a driving gear (not shown) which is affixed to the shaft of the other crush roll and which gears are cooperatively related, rotation of pinion 38 drives the crush rolls in an appropriate manner to perform a crushing and trash removal operation of the fiber supplied to the crush rolls from the take-off roll 6 and the re-directing roll 6*a*.

In order to draw the crushed fiber web W from the crush roll system, one of the calendar rolls 8 is fixedly mounted on the same shaft as the driving pinion 39 which is driven by pinion 40 which in turn meshes with pinion 41 coupled with idler gear 34 so that rotation is imparted to one of the calendar rolls by the pinion 39 when the system is in operation.

Should it be desired to deactivate the calendar rolls, a manually operable lever 42 is mounted on frame 1 in such manner as to cooperate with driving gear 40. Driving gear 40 in reality constitutes a pair of gears one of which is coupled with driving gear 41 and the other of which is coupled with driven pinion 39 through a suitable spring biased clutch mechanism which mechanism (not shown) is controlled by manually operable lever 42. By this means operation of the calendar rolls may be initiated or discontinued by appropriate movement of the operating arm 42, such manual control being conventional.

Figure 3:
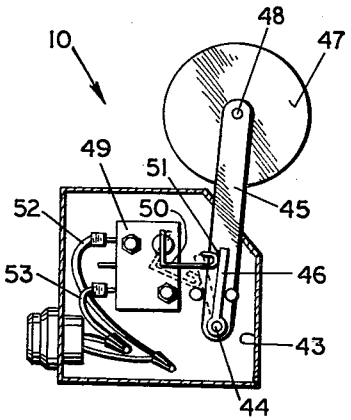

Stop control means includes the wheel station which is responsive to the tension of sliver SL to shut down the crush roll system when such tension is substantially reduced. The wheel station is generally designated by the numeral 10 in FIG. 1 and is best shown in FIG. 3. The wheel station comprises housing structure 43 secured atop the coiler 9. A mounting pin 44 is secured to housing 43 and constitutes a pivot on which operating arm 45 together with interconnected switch control arm 46 are mounted. A spool 47 is rotatably mounted via a pin 48 to the swing end of operating arm 45. A microswitch generally designated by the numeral 49 is provided with an operating element 50 whose curved end 51 is in engagement with operating lever 46. Micro-switch 49 is provided with control contacts not shown which in turn control the flow of electric current through electric conductors 52 and 53 which in turn form parts of the control circuit shown schematically in FIG. 4.

Operating arm 45 is held in the position shown in dotted lines in FIG. 3 in which position the microswitch contacts are closed. This condition is maintained so long as the sliver is properly trained over spool 47 and provided its tension is within normal operating limits. Should the sliver break or should its tension become substantially reduced, operating arm 45 swings clockwise to cause lever 46 to occupy the position shown in solid lines in FIG. 3 due primarily to the bias of gravity and opens the contacts of the microswitch to perform a control operation. Such a control operation shuts down the crush roll system. Actually the arm 45 and lever 46 preferably are substantially vertical at all times and but a slight angular swing is necessary to move from their extreme positions. In FIG. 3 the angle between the solid line and the dotted line positions of lever 46 is shown somewhat larger than is desirable for best practical results. In practice this angle is small so that very little angular movement is necessary. The arm 45 and the lever 46 are always on the same side of an imaginary vertical line through pivot 44 so that very little movement of arm 45 and of lever 46 is required. By this means the drive is characterized by a high degree of sensitivity. Gravity force versus the opposite force exerted by the weight and tension of the sliver thus is employed to stop the system when the sliver breaks or its tension is reduced for any reason.

Figure 4:
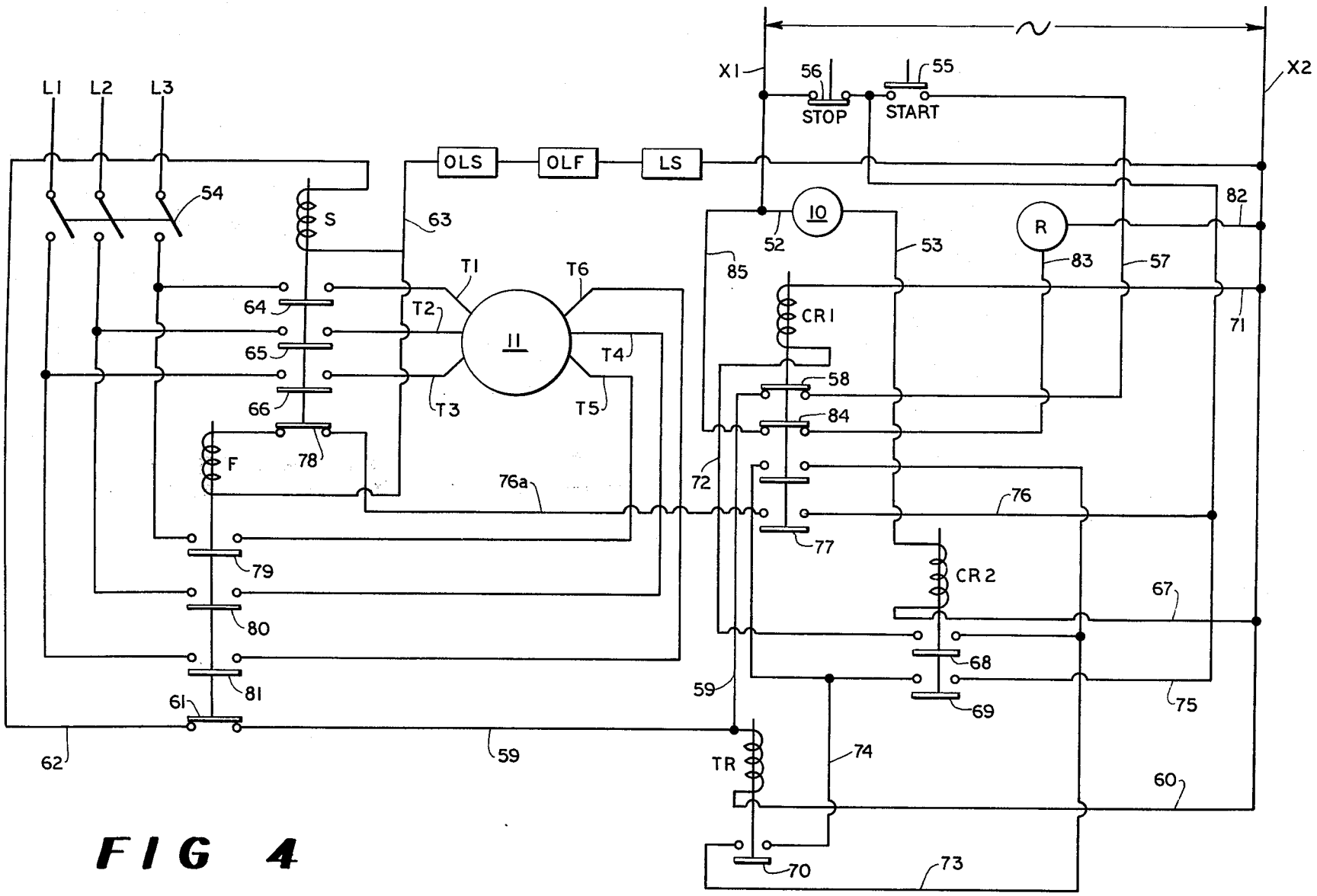
FIG. 4 is a schematic wiring diagram showing the crush roll operating system.

Control of the crush roll system including control of the doffer, the take-off roll, the calendar rolls as well as the crush rolls, the feed roll, the licker-in and the lap is effected by controlling motor 11 and such is accomplished in accordance with this invention by the circuitry schematically shown in FIG. 4. All relays in FIG. 4 are shown with their operating coils deenergized and such condition is treated herein as normal.

The two-speed driving motor 11 is arranged with two sets of windings such that when power is supplied to motor 11 through incoming leads T1, T2, and T3, the motor is operated at slow speed. When motor 11 is energized through lines T4, T5, and T6 rather than through lines T1, T2, and T3, the motor is operated at high speed. Thus in general terms the schematic arrangement of FIG. 4 includes a three-phase source of energy designated by the incoming lines L1, L2 and L3 which through the power contacts of starting relay S and alternately through the power contacts of relay F constitute a power supply for the main operating windings of motor 11 to cause that motor to operate at either slow or high speed controlled by the condition of the circuit.

In FIG. 4, control energy for the system is supplied from lines X1 and X2 through suitable start and stop switches, relays CR1 and CR2, timing relay TR and the wheel station 10 to effect control of the motor 11 as desired and in turn to control the crush rolls and associated elements other than the main cylinder 2.

In order to start the card, a manual switch (not shown) is actuated by the operator which in turn energizes the driving motor (not shown) for the main card cylinder 2. Thus the main card cylinder is brought up to operating speed following which the three pole single-throw manually operable switch shown in FIG. 4 and designated by the numeral 54 is closed and the manually operable start button 55 is closed. This operation completes a circuit from line X1 through normally closed manually operable stop button 56, manually operable normally open start button 55, conductor 57, normally closed contacts 58 of relay CR1, through conductor 59 to the operating coil of timer relay TR and conductor 60 to line X2 to initiate a timing cycle by timing relay CR at the end of which contacts 70 close. Simultaneously energy is supplied from conductor 59 through normally closed contacts 61 of the relay F directly to the coil of relay S via conductor 62 and through overload relays OLS and OLF and through lap switch LS to the line X2 to cause the slow speed relay S to close its normally open contacts 64, 65, and 66 thereby to energize motor 11 through lines T1, T2 and T3. With the circuit in the condition described, motor 11 comes up to slow speed operation and operates the crush roll and associated mechanisms shown in FIGS. 1 and 2 at slow speed.

While the motor is operating at slow speed for a pre-determined time, controlled by the time setting of time delay relay TR, the operator threads the sliver SL over spool 47 and into the head of coiler 9. The sliver SL thus is fed into the coiler under normal tension and the contacts within micro-switch 49 are closed because the operating arm 45 and the operating lever 46 are held in their operated positions by the tension of sliver SL against the bias of gravity and a circuit is complete under these conditions from line X1 through conductor 52 and the contacts 49 controlled by the wheel station operating arm 45 and by operating lever 46 through conductor 53 and the coil of the relay CR2 to the control power line designated X2 through conductor 67. This condition of course causes the relay CR2 to pick up and to close its normally open contacts 68 and 69.

With the contacts 68 and 69 of relay CR2 in closed positions, the circuit is in proper condition to be controlled by the timing relay TR.

When the timing cycle of the timing relay TR is completed, the contacts 70 close and energy is thus supplied to the coil of relay CR1 to cause that relay to pick up. More specifically a circuit is completed from line X2 through conductor 71, the coil of relay CR1 and conductor 72 through the now closed contacts 68 of relay CR2 through conductor 73, the now closed contacts 70 of the TR relay, conductor 74 through the now closed contacts 69 of the CR2 relay, and through conductor 75 and the normally closed stop switch 56 to line X1. In this manner relay CR1 is energized.

Energization of relay CR1 opens normally closed contacts 58 of that relay and interrupts the circuit from line X1, the stop switch 56, closed start switch 55, through conductor 57, now open contacts 58, conductor 59, normally closed contacts 61, conductor 62, to the coil of relay S and thus causes that relay to drop out.

When relay S drops out its contacts 78 become closed and the coil of the F relay is thus energized from line X1 through the normally closed stop switch 56 through conductor 76, the now closed contacts 77 of relay CR1, through conductor 76*a*, the contacts 78 and the coil of relay F, conductor 63 and the overlaod relays OLS and OLF, and lap switch LS to line X2 to cause the F relay to pick up and thereby to complete a circuit through its power contacts 79, 80 and 81 to lines T4, T5 and T6 thereby to cause motor 11 to operate at high speed. Operation of relay F opens its contacts 61 and thus prevents energization of the coil of relay S which is in series therewith.

Should the tension of sliver SL be reduced substantially as by the breakage of the sliver or for any other reason, the circuit through the micro-switch 49 designated in FIG. 4 at 10 is interrupted and the coil of relay CR2 is thus de-energized causing its contacts 68 and 69 to open. When this occurs the coil of relay CR1 is de-energized because the contacts 68 form a part of the circuit for the coil of relay CR1. When CR1 opens, the coil of the fast relay F is de-energized because the contacts 77 of relay CR1 are thus opened and serve to interrpt the circuit to the F relay coil allowing that relay to drop out thereby de-energizing the power lines T4, T5 and T6 to motor 11 to cause the motor to stop.

Stoppage of motor 11 is indicated by indicating means comprising indicating lamp R which is energized from line X2, conductors 82 and 83, normally closed contacts 84 of relay CR1, conductor 85 and source X1. Thus when relay CR1 drops out and stops motor 11, its normally closed contacts 84 close and energize the indicating lamp R which affords a visible indication of a shut down.

From the above description it is apparent that normally open manual start switch 55, relay S and circuitry associated therewith constitute starting control means for the two-speed motor 11. Furthermore it is apparent that the operating control means for the crush roll system includes relay CR1, relay F and parts associated therewith which are regulated by the timing means TR and associated circuitry. It is also apparent that the stop control means includes the wheel station 10, relay CR2 and circuitry associated therewith. Furthermore it is apparent that the stop control means is ineffective to perform a stopping operation so long as the starting control means is functioning to operate the motor at low speed. Stated otherwise the automatic stop control means including the wheel station 10 and relay CR2 is effective to control only the operating control means which includes the relay CR1 and the relay F but is ineffective to control the starting control means.

From the above description it is apparent that by the invention, a compact arrangement is provided which conserves valuable floor space adjacent the card and the crush roll system and that the belt slippage problem which commonly characterizes conventional systems is completely eliminated. Also the system of this invention is fully automatic and thus is effective to eliminate delays in bringing the system up to full operating speed whereby substantially increased production is achieved.

The embodiments of the invention in which an exclusive property or privilege is claimed are defined as follows:

1. A textile card crush roll operating system comprising a crush roll driving motor operable both at slow and at high speeds, starting control means for energizing said motor so as to cause it to operate at low speed, electric timing means actuated independently of the crush rolls in coordination with actuation of said starting control means to initiate a timing cycle, operating control means activated upon completion of said timing cycle for causing said motor to operate at high speed, and automatic stop control means responsive to normal operating tension of sliver supplied from the crush rolls for rendering said operating control means effective and for deactivating said operating control means in response to subnormal sliver operating tension.

2. A system according to claim 1 wherein said starting control means when activated is effective to prevent operation of said operating control means.

3. A system according to claim 1 wherein said operating control means when activated in effective to render said starting control means ineffective.

4. A system according to claim 1 wherein said automatic stop control means is ineffective to prevent operation of said starting control means.

5. A system according to claim 1 wherein said automatic stop control means comprises a pivotally mounted, substantially vertically disposed gravity biased operating arm movable between a normal system operating position and a stop position to control said operating control means and in turn to control the high speed but not the slow speed operation of said motor.

6. A textile card crush roll operating system comprising a crush roll driving motor operable both at slow and at high speeds, starting control means for energizing said motor so as to cause it to operate at low speed, electric timing means actuated independently of the card and in coordination with actuation of said starting control means to initiate a timing cycle, operating control means activated upon completion of said timing cycle for causing said motor to operate at high speed, and automatic stop control means responsive to normal operating tension of sliver supplied from the crush rolls for rendering said operating control means effective and for deactivating said operating control means in response to subnormal sliver operating tension, said automatic stop control means including a pivotally mounted, substantially vertically disposed operating arm movable between a normal system operating position and a stop position to control said operating control means and in turn to control the high speed but not the slow speed operation of said motor.

7. A system according to claim 1 wherein indicating means is operable in coordination with operation of said operating control means to monitor high speed but not slow speed operation of said driving motor.

* * * * *